US008231419B2

(12) United States Patent
Nakamura

(10) Patent No.: US 8,231,419 B2
(45) Date of Patent: Jul. 31, 2012

(54) WATER JET PROPULSION WATERCRAFT

(75) Inventor: Mitsuyoshi Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 353 days.

(21) Appl. No.: 12/563,492

(22) Filed: Sep. 21, 2009

(65) Prior Publication Data

US 2010/0075551 A1 Mar. 25, 2010

(30) Foreign Application Priority Data

Sep. 24, 2008 (JP) ..... 2008-243558

(51) Int. Cl.
*B63H 23/34* (2006.01)

(52) U.S. Cl. ..... 440/83

(58) Field of Classification Search ..... 440/83, 440/75

See application file for complete search history.

(56) References Cited

U.S. PATENT DOCUMENTS

| | | | | |
|---|---|---|---|---|
| 4,121,532 | A * | 10/1978 | Coryell, III | 440/83 |
| 2003/0015128 | A1 | 1/2003 | Gokan et al. | |
| 2003/0140889 | A1 | 7/2003 | Matsuda et al. | |
| 2004/0194682 | A1 | 10/2004 | Matsuda | |
| 2006/0063443 | A1 * | 3/2006 | Nakagawa et al. | 440/83 |
| 2006/0205293 | A1 * | 9/2006 | Fuse | 440/83 |

* cited by examiner

*Primary Examiner* — Stephen Avila
(74) *Attorney, Agent, or Firm* — Keating & Bennett, LLP

(57) ABSTRACT

A water jet propulsion watercraft includes a main engine body, a rotor chamber disposed at a rear portion of the main engine body, a crankshaft disposed so as to extend penetratingly through the rotor chamber such that a rear end portion thereof protrudes to an outer side of the rotor chamber, a rotor unit coupled to the crankshaft inside the rotor chamber, a drive shaft connected to the rear end portion of the crankshaft and rotated together with the crankshaft, and a jet propulsion unit, having an impeller that is coupled to the drive shaft, and arranged to suck in and jet out water. The crankshaft includes a flange portion that is integral with the crankshaft inside the rotor chamber. The rotor unit is fixed to the flange portion.

20 Claims, 8 Drawing Sheets

FWD
BWD
5
6
L1
88
2g
87
87a
88a
86
2d
2e
2f
83
2c
81
85
84
81
82
64
79
75
66
62a
70
62
54
73
80
65
63
51
56
55
55
56
52
58
53
57
61
59
60a
60
61a
52a
55
55
56
56
60b

FWD BWD

WATER JET PROPULSION WATERCRAFT

BACKGROUND OF THE INVENTION

1. Field of the Invention

The present invention relates to a water jet propulsion watercraft including a jet unit (jet propulsion device) having an engine (internal combustion engine) as a drive source.

2. Description of Related Art

An example of a water jet propulsion watercraft is disclosed in U.S. Patent Application Publication No. 2004/0194682 A1. This water jet propulsion watercraft includes a hull, a water jet pump, and an engine. The engine applies a driving force to the water jet pump. The water jet pump includes a propeller shaft rotated by the driving force of the engine, and an impeller coupled to the propeller shaft. By rotation of the propeller shaft, water is sucked in from a hull bottom and the water is jetted rearward by the impeller. A propulsive force is thereby applied to the hull.

The engine has a crankcase at a lower side. A crankshaft housed in the crankcase is extended to a rear of the crankcase, and an extended axial member is coupled to a rear end of the crankshaft. The propeller shaft is coupled to the extended axial member via a coupling.

A housing is disposed at the rear of the crankcase. The crankshaft is coupled to the extended axial member inside the housing. A power generator, which is a heavy object, is disposed inside the housing. A center of gravity of the small planing watercraft can thus be positioned at the rear.

To dispose the power generator at the rear of the crankcase, a space for disposing the power generator has to be secured between the crankcase and the coupling. The extended axial member is disposed between the crankshaft and the coupling to secure this space.

More specifically, a rear end portion of the crankshaft has a tapered shape portion, at the rear of which a male screw is formed coaxial with a rotational center axis of the crankshaft. A female screw, engageable with the male screw, is formed at a front end portion of the extended axial member. During assembly, the female screw of the extended axial member is fastened to the male screw of the crankshaft with a rotor of the power generator being disposed at the tapered shape portion of the crankshaft. The rotor and the extended axial member are thereby fixed to the crankshaft.

SUMMARY OF THE INVENTION

The inventor of the preferred embodiments of the present invention described and claimed in the present application conducted an extensive study and research regarding a water jet propulsion watercraft, such as the one described above, and in doing so, discovered and first recognized new unique challenges and problems as described in greater detail below.

That is, with the above-described water jet propulsion watercraft, the crankshaft must be made small in axial diameter at a connection portion of the rear end portion of the crankshaft and the extended axial member. There is thus a problem that it is difficult to improve the durability of the crankshaft.

In order to overcome the previously unrecognized and unsolved problem described above, a preferred embodiment of the present invention provides a water jet propulsion watercraft that includes a main engine body, a rotor chamber disposed at a rear portion of the main engine body, a crankshaft disposed so as to extend penetratingly through the rotor chamber such that a rear end portion thereof protrudes to an outer side of the rotor chamber, a rotor unit coupled to the crankshaft inside the rotor chamber, a drive shaft connected to the rear end portion of the crankshaft and rotated together with the crankshaft, and a jet propulsion unit, having an impeller that is coupled to the drive shaft, arranged to suck in and jet out water. The crankshaft includes a flange portion that is integral with the crankshaft inside the rotor chamber. The rotor unit is fixed to the flange portion.

According to the present water jet propulsion watercraft, an extended axial member or other intermediate member does not have to be provided between the crankshaft and the drive shaft. The crankshaft thus does not have to be made small in axial diameter at a connection portion of the crankshaft and such an intermediate member. Consequently, the durability of the crankshaft can be improved.

Also, the rotor chamber is disposed at the rear of the main engine body, and the rotor unit is disposed inside the rotor chamber. A center of gravity of the water jet propulsion watercraft can thereby be disposed toward the rear, which contributes to motion performance (mainly, turning performance) of the water jet propulsion watercraft.

Further, the flange portion for attaching the rotor unit to the crankshaft is preferably integral with the crankshaft. The rotor unit can thereby be attached to the crankshaft in a stable state. Moreover, the crankshaft penetrates through the rotor chamber and the flange portion can thus be formed inside the rotor chamber at a position suited for attachment of the rotor unit. In other words, a degree of freedom of disposition of the rotor unit that is to be fixed directly to the crankshaft is made high. Consequently, components inside the rotor chamber can be disposed with priority placed on ease of assembly, etc.

Thus, with the arrangement of the present preferred embodiment, the durability of the crankshaft can be improved and the degree of freedom of disposition of components inside the rotor chamber can be made high while disposing the center of gravity at the rear.

For maintenance after use, a user of a water jet propulsion watercraft races the engine on land. Water inside the hull can thereby be eliminated. Unlike on water, a load due to water is not applied to the impeller during the racing on land. Thus, when the user performs rapid closing of the accelerator from a state where it is open, a rotational speed of the crankshaft decreases sharply. Consequently, a rotational direction force (load) is applied to the drive shaft due to a rotational inertial force of the impeller and the drive shaft. Thus, with the arrangement of the conventional art described above, there is a possibility of loosening of the engagement portions of the extended shaft member and the crankshaft. Such a problem does not occur with the arrangement of the present preferred embodiment with which there is no need to provide an extended shaft member.

In a preferred embodiment of the present invention, the rotor unit includes a flywheel unit, fixed to the flange portion of the crankshaft and stabilizing the rotation of the crankshaft by being rotated together with the crankshaft. By this arrangement, the flywheel unit, which is a heavy object, can be fixed readily and in a stable state to the crankshaft by the flange portion.

The rotor unit may be a rotor unit of a power generator that generates electricity by a driving force of the engine. The rotor unit may also serve the role of the flywheel unit as well.

Besides the above, the rotor unit may be a gear unit, to which a driving force from a starter motor is transmitted (preferably transmitted via a one-way clutch). Or, the rotor unit may be a gear unit that transmits the driving force of the engine to a supercharger. Yet further, the rotor unit may be a sprocket engaged to a cam chain that transmits power to a cam that drives an air intake valve and an exhaust valve. Besides the above, a rotating member that is to be rotated by the driving force of the engine can be the rotor unit.

In a preferred embodiment of the present invention, the rotor unit is fixed to a rear surface of the flange portion and a portion thereof is disposed to extend toward the front so as to cover an outer peripheral portion of the flange portion. For example, the rotor unit may be combined with a stator unit to make up a power generator. In this case, the rotor unit and the stator unit may be made to oppose each other at a front side relative to the rear surface of the flange portion. That is, the stator unit may be positioned at a front side (the main engine body side) relative to the rotor unit. Thus, for example, a structure with which the stator unit is supported on the main engine body can be adopted.

A water jet propulsion watercraft according to a preferred embodiment of the present invention further includes a plurality of fastening units arranged to fasten the rotor unit to the flange portion of the crankshaft. The plurality of fastening units are mutually spaced apart at predetermined intervals along a circumference of predetermined radius centered on a rotational center axis of the crankshaft. By this arrangement, the rotor unit can be fastened firmly with respect to the crankshaft and yet uniformly around the rotational center axis. Moreover, the rotation of the crankshaft can be transmitted reliably to the rotor unit because the rotor unit is fastened to the flange portion at positions away from the rotational center axis. Also, in a case where the rotor unit is a flywheel unit, its rotation due to inertia can be transmitted reliably to the crankshaft.

Preferably in this case, each of the fastening units includes a screw insertion hole arranged in a portion of the rotor unit at the rear relative to the flange portion of the crankshaft, a screw hole arranged in the flange portion of the crankshaft, and a screw member arranged to pass through the screw insertion hole of the rotor unit and to be threadedly fixed in the screw hole of the crankshaft. By this arrangement, a work of fastening the rotor unit to the crankshaft can be performed from an outer side (rear side) of the main engine body. The rotor unit can thus be fastened firmly and uniformly to the crankshaft with ease.

A water jet propulsion watercraft according to a preferred embodiment of the present invention further includes a positioning structure disposed at a position spaced by a predetermined distance from the rotational center axis of the crankshaft and arranged to restrict relative rotations of the flange portion and the rotor unit about the rotational center axis to set the position of the rotor unit with respect to the crankshaft. By this arrangement, positioning of the rotor unit in the rotational direction with respect to the crankshaft can be ensured. The rotation of the crankshaft can thereby be transmitted more reliably to the rotor unit. In the case where the rotor unit is a flywheel unit, its rotation due to inertia can be transmitted to the crankshaft reliably.

In a preferred embodiment of the present invention, the rotor unit includes a plate portion fixed to the flange portion of the crankshaft and positioned at the rear of the flange portion, and a main rotor portion attached to the plate portion and arranged to extend forward. By this arrangement, the plate portion can be fixed to be brought into planar contact with the flange portion and the rotor unit can thus be attached with stability to the crankshaft. Also, by attaching the main rotor portion to the plate portion, the fixing of the main rotor portion to the crankshaft is facilitated.

Preferably in this case, the plate portion and the main rotor portion of the rotor unit are fastened by riveting, for example. By this arrangement, the plate portion and the main rotor portion can be fastened firmly to each other by riveting without becoming loose. That is, the rotation of the crankshaft can thus be transmitted reliably to the main rotor portion and the rotation due to inertia of the main rotor portion can be transmitted reliably to the crankshaft.

A water jet propulsion watercraft according to a preferred embodiment of the present invention further includes a stator unit disposed inside the rotor chamber so as to overlap with the flange portion when viewed from a direction orthogonal to the crankshaft, and the stator unit has its periphery surrounded by the rotor unit. By this arrangement, the stator unit is disposed so as to be overlapped with the flange portion and a length in a front-rear direction of the crankshaft can thus be suppressed. By surrounding the periphery of the stator unit with the rotor unit, the rotor unit can be made to oppose the stator unit. A power generator that generates electric power by a magnetic interaction of the stator unit and the rotor unit can thereby be arranged.

Preferably, a portion of the crankshaft at a rear side relative to the flange portion has a substantially uniform diameter in the interior of the rotor chamber. By this arrangement, the durability of the crankshaft can be improved further.

A water jet propulsion watercraft according to a preferred embodiment of the present invention further includes a coupling member attached to the crankshaft and arranged to connect the crankshaft and the drive shaft, and a pressing member attached to the crankshaft so as to press the coupling member toward the crankshaft and arranged to suppress the coupling member from falling off the crankshaft. By this arrangement, the coupling member can be prevented from falling off the crankshaft even when a force tending to make the coupling member fall off from the crankshaft is applied to the crankshaft and the coupling member.

In a preferred embodiment of the present invention, the main engine body includes a crankcase arranged to house the crankshaft, and the water jet propulsion watercraft further includes a stator unit disposed inside the rotor chamber so as to surround an outer peripheral portion of the crankshaft in the interior of the rotor chamber and being attached to the crankcase. By this arrangement, assembly of the water jet propulsion watercraft is facilitated. For example, in a case where a stator unit is attached to a cover that covers a rotor chamber, the stator unit is drawn towards a magnet of a rotor unit during attachment of the cover to a crankcase side. It is thus difficult to attach the cover to the crankcase side. In contrast, with the above-described arrangement of the preferred embodiment, the stator unit is attached to the crankcase and there is thus no need to attach the stator unit to the cover that covers the rotor chamber. The cover can thus be attached to the crankcase side with ease.

A water jet propulsion watercraft according to a preferred embodiment of the present invention further includes a starter motor arranged to be driven when the engine is started, a first gear arranged to output a driving force of the starter motor, a second gear coupled to the first gear in a manner enabling constant transmission of power and arranged to transmit the driving force of the starter motor to the crankshaft, and a one-way clutch disposed between the rotor unit and the second gear, and arranged to make the second gear run idle with respect to the crankshaft such that the driving force of the crankshaft is not transmitted to the second gear while the engine is running. By this arrangement, during starting of the engine, the driving force of the starter motor is transmitted to the crankshaft via the first gear, the second gear, and the one-way clutch. The engine is thereby started. On the other hand, while the engine is running, the one-way clutch does not transmit the rotation of the crankshaft to the second gear.

U.S. Patent Application Publication No. 2004/0194682 A1 discloses a structure in which gears that transmit the driving force of a starter motor are mutually engaged during the starting of the engine, and the mutual engagement of these gears is disengaged after completion of the starting of the engine. However, with this structure, the gears and the motor become damaged readily because the mutual engagement and disengagement of the gears are repeated. In contrast, with the arrangement described above, even though the engagement between gears is not disengaged, the driving force of the engine is not transmitted to the stator motor side by the function of the one-way clutch after completion of the starting of the engine. A highly reliable structure with a low occurrence of malfunction can thus be provided.

Preferably, the crankshaft further includes an oil passage portion arranged to supply oil to the one-way clutch. By this arrangement, oil can be supplied to the one-way clutch with ease. For example, oil can be supplied to the one-way clutch by supplying the oil to the oil passage from the main engine body side.

Preferably, the one-way clutch is fixed to the rotor unit. With this arrangement, the one-way clutch can be fixed to the flange portion of the crankshaft via the rotor unit. Viewed in another way, a rotating member of the one-way clutch at the flange portion side is an example of the rotor unit fixed to the flange portion.

Preferably, the second gear is rotatably supported on the crankshaft at the rear relative to the flange portion. The one-way clutch includes a first rotating member at the flange portion side and a second rotating member at the second gear side, and is arranged to transmit a relative rotation of the second rotation member in one direction with respect to the first rotating member and not transmit the relative rotation in the other direction. While the engine is running, the second gear runs idle about the crankshaft.

The second gear cannot be disposed at the front relative to the flange portion because the flange portion is formed on the crankshaft, and the second gear is thus supported on the crankshaft at the rear relative to the flange portion. The stator unit, which, as mentioned above, makes up the power generator together with the rotor unit that is fixed to the flange portion, can be supported on the main engine body (for example, the crankcase) at the front relative to the flange portion. There is thus no need to secure a space for positioning the stator unit at the rear of the flange portion. The space inside the rotor chamber can thus be utilized effectively to compactly house the stator unit and the second gear. Moreover, workability during attachment of the cover of the rotor chamber can be improved as mentioned above.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
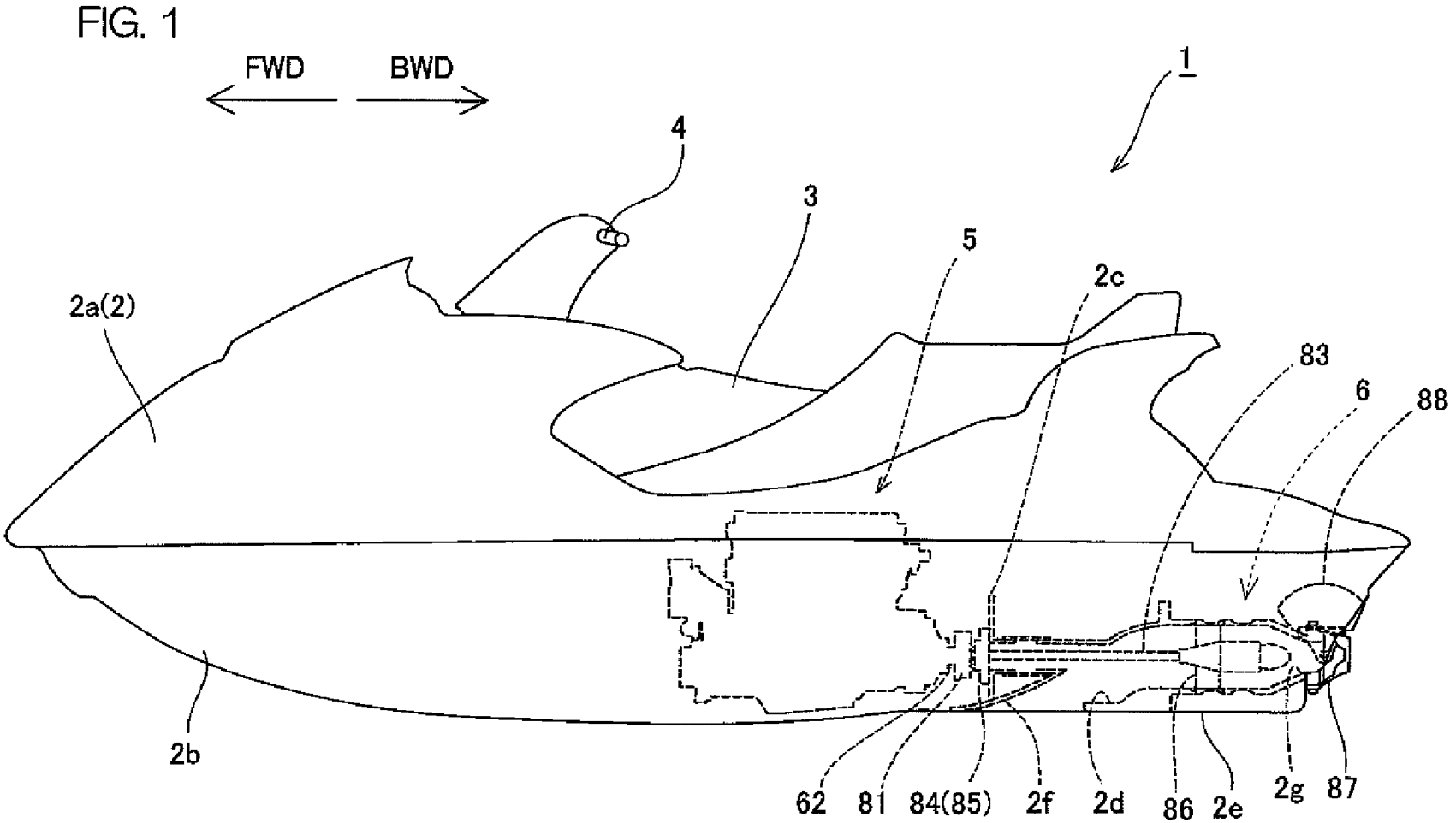
FIG. 1 is a side view of an overall arrangement of a water jet propulsion watercraft according to a preferred embodiment of the present invention.

FIG. 1 is a side view of an overall arrangement of a water jet propulsion watercraft according to a preferred embodiment of the present invention.

The water jet propulsion watercraft 1 of the preferred embodiment includes a hull 2, a seat 3, a steering apparatus 4, an engine 5, and a jet propulsion unit 6. The hull 2 is made up of a deck 2*a* and a hull body 2*b*. The seat 3 is disposed on an upper portion of the hull 2. The steering apparatus 4 arranged for an operator to steer the hull 2 is disposed in front of the seat 3. The engine 5 is disposed in an engine room formed in an interior of the hull body 2*b*. The jet propulsion unit 6 is disposed at the rear of the engine 5 inside the hull body 2*b*.

Figure 2:
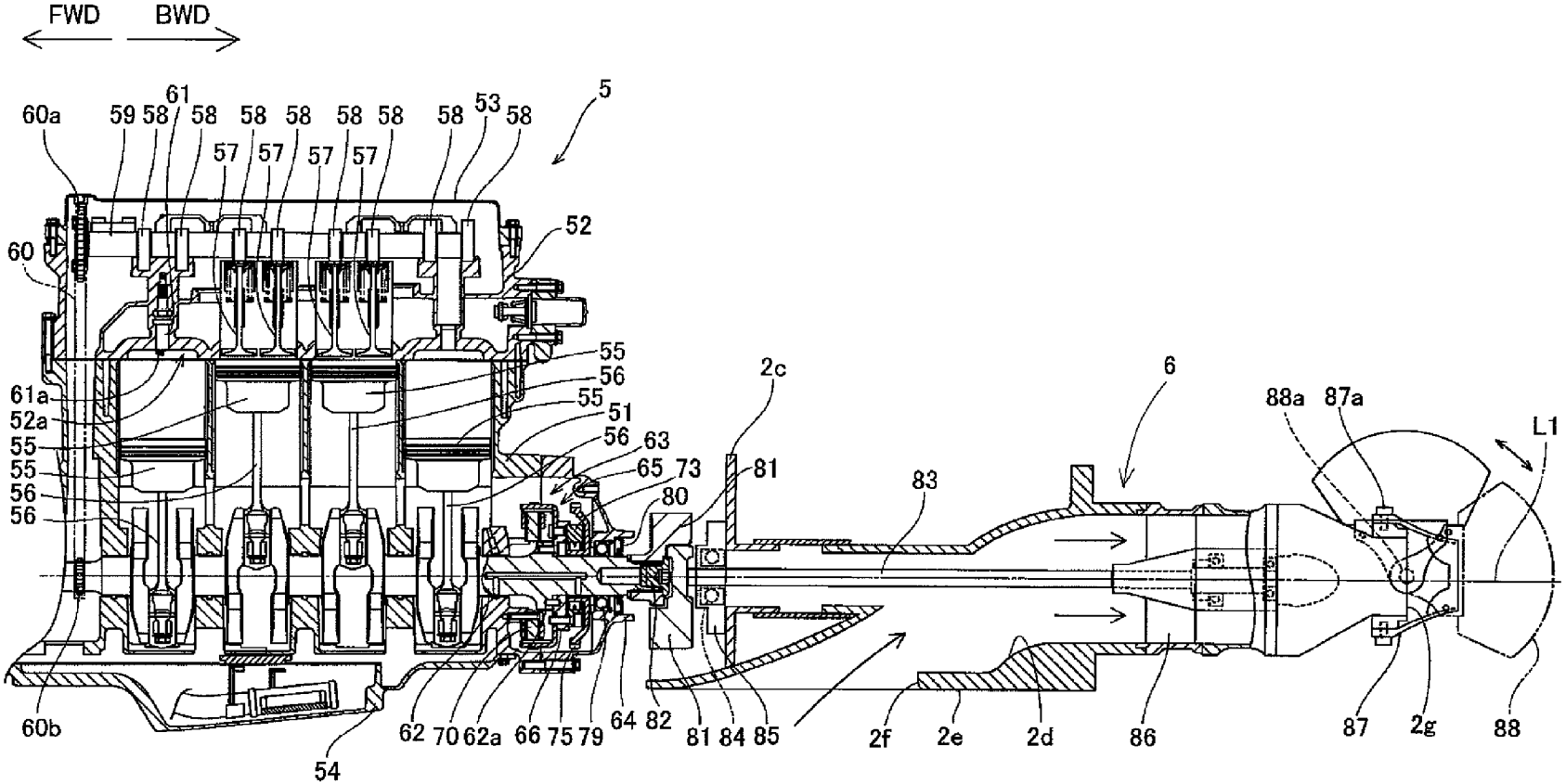
FIG. 2 is a sectional view for describing an arrangement of an engine and a periphery of a drive shaft of the water jet propulsion watercraft according to the preferred embodiment shown in FIG. 1.

FIG. 2 is an enlarged sectional view of the engine 5 and the jet propulsion unit 6. The jet propulsion unit 6 includes a drive shaft 83, an impeller 86, a deflector 87, and a reverse bucket 88. A crankshaft 62 protrudes from a rear portion of the engine 5, and a coupling member 81 is attached to a rear end of the crankshaft 62. At the rear of the coupling member 81, the drive shaft 83 is disposed so as to extend rearward. The drive shaft 83 is supported by a bearing 84 attached to a bulkhead 2*c* of the hull 2. The bearing 84 is covered by a sealing member 85 and is arranged to suppress inflow of water into the engine room. The impeller 86 is attached to a rear portion of the drive shaft 83. The impeller 86 is fixed to the drive shaft 83 and is arranged to rotate together with the drive shaft 83. The impeller 86 is also disposed in a water passage portion 2*d* formed at a lower portion of the hull 2 and performs the functions of drawing up water from a water inflow portion 2*f* of a hull bottom 2*e* and jetting out water from a water discharging portion 2*g* at a rear portion of the hull 2. The deflector 87, which controls a water jetting direction by converting the direction to the left and right, is attached to the water discharging portion 2*g*. The deflector 87 is arranged to be rotatable in left and right directions about an axial portion 87*a* in linkage with the steering apparatus 4 (see FIG. 1). The reverse bucket 88, which reverses the direction of water jetted from the water discharging portion 2*g* to an FWD arrow direction side during reverse drive, is attached to the water discharging portion 2*g*. The reverse bucket 88 is arranged to be rotatable in up and down directions about an axial portion 88*a*. The reverse bucket 88 is disposed at a position at which it is sprung upward during forward drive, and is disposed at the rear of the water discharging portion 2*g* during reverse drive.

Figure 3:
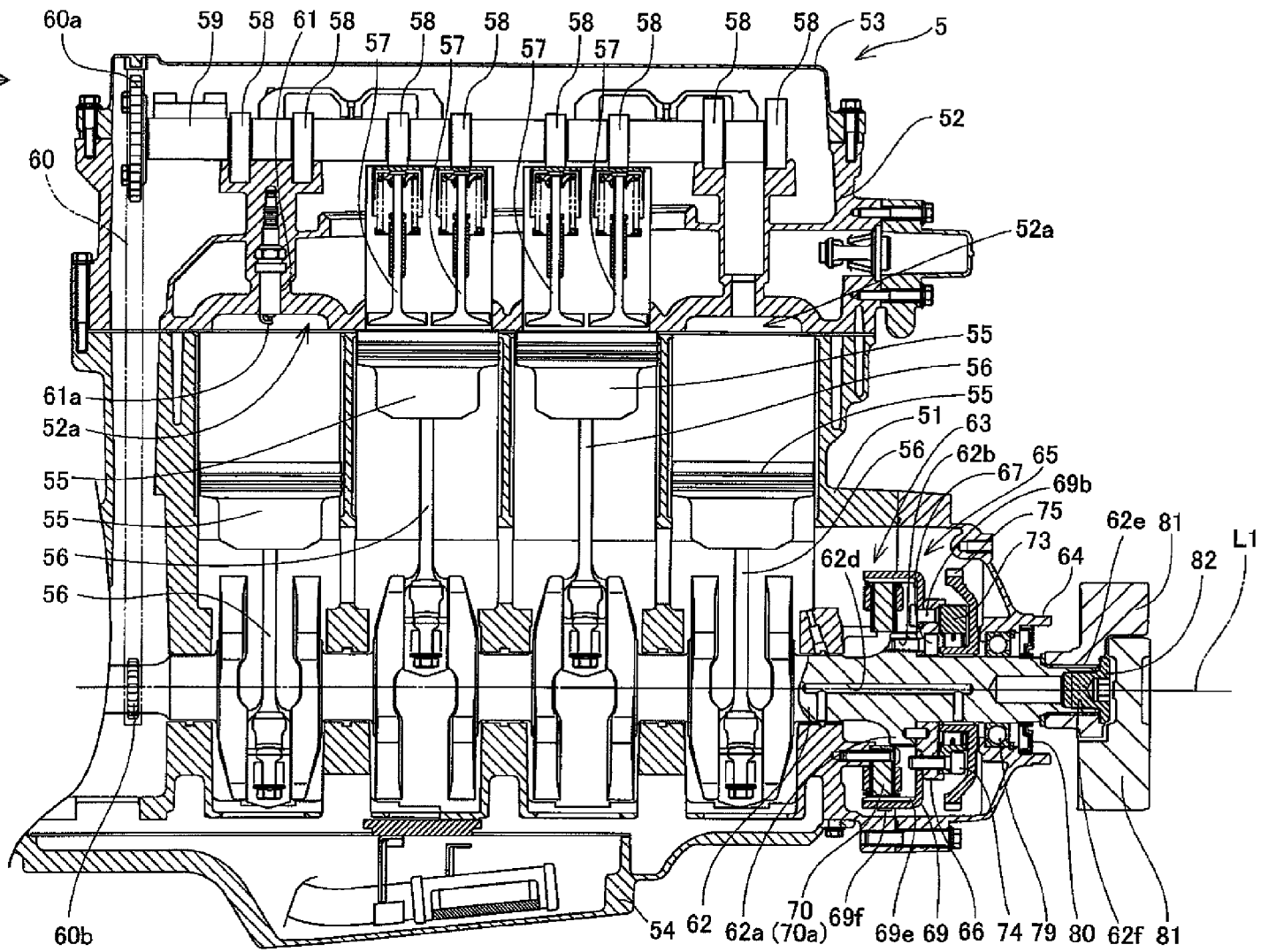
FIG. 3 is a sectional view of the engine of the water jet propulsion watercraft according to the preferred embodiment shown in FIG. 1.

FIG. 3 is a further enlarged sectional view of the arrangement of the engine 5. The engine 5 includes a cylinder body 51, a cylinder head 52, a cylinder head cover 53, and a crankcase 54 that houses the crankshaft 62. The cylinder body 51, the cylinder head 52, the cylinder head cover 53, and the crankcase 54 define a main engine body. The cylinder body 51 has pistons 55 disposed therein in a manner enabling sliding along its inner peripheral surface. An upper end of a connecting rod 56 is rotatably attached to each piston 55. The cylinder head 52 is disposed so as to close an opening at one side of the cylinder body 51. Also, air intake valves 57 and exhaust valves (not shown) are disposed in the cylinder head 52. Cams 58 and a camshaft 59 are disposed in the cylinder head 52. The cams 58 move the air intake valve 57 and the exhaust valve (not shown) at predetermined timings. The camshaft 59 rotates the cams 58. A chain 60 is disposed at one side of the camshaft 59.

Specifically, a sprocket 60*a* is disposed at one side of camshaft 59, and the chain 60 is engaged with the sprocket 60*a*. The chain 60 is further engaged with a sprocket 60*b* fixed to a front end of the crankshaft 62. Therefore, the chain 60 is thus driven in accompaniment with the rotation of the crankshaft 62. That is, the camshaft 59 is arranged to be rotated by the crankshaft 62 being rotated.

Ignition plugs 61 are disposed in the cylinder head 52. A front end 61*a* of each ignition plug 61 is disposed to protrude into a combustion chamber 52*a* defined by the cylinder body 51, the cylinder head 52, and the piston 55. The cylinder head cover 53 is attached to the cylinder head 52 so as to cover the camshaft 59.

The cylinder body 51 is attached to the crankcase 54. The crankshaft 62 is supported in a state of being sandwiched between the cylinder body 51 and the crankcase 54.

In this preferred embodiment, the crankshaft 62 is attached to the crankcase 54 and the cylinder body 51 so as extend in a front-rear direction. A rear portion of the crankshaft 62 is housed in an interior of an auxiliary machinery chamber 63. Further, a rear end portion of the crankshaft 62 is disposed so as to protrude outside the auxiliary machinery chamber 63.

The lower ends of the connecting rods 56 are rotatably attached to the crankshaft 62. The crankshaft 62 is thereby arranged to be rotated in accompaniment with the pistons 55 being slid up and down. The sprocket 60*b* is fixed to a front side (FWD arrow direction side) portion of the crankshaft 62. The chain 60 is engaged with the sprocket 60*b*.

The auxiliary machinery chamber 63 is disposed at a rear portion of the cylinder body 51 and the crankcase 54. A stator unit 70 and a rotor unit 65, to be described later, and other auxiliary machinery are disposed inside the auxiliary machinery chamber 63. Specifically, the auxiliary machinery chamber 63 is formed of a rear end portion of the cylinder body 51, a rear end portion of the crankcase 54, and a cover member 64, and has a housing space in its interior. The cover member 64 covers the rear end portion of the cylinder body 51 and the rear end portion of the crankcase 54. In addition, the auxiliary machinery chamber 63 is an example of a "rotor chamber" according to a preferred embodiment of the present invention and the cover member 64 is an example of a "main engine body" according to a preferred embodiment of the present invention. "Auxiliary machinery" refers to auxiliary machinery accessory to the engine 5, which is the main machinery.

Figure 4:
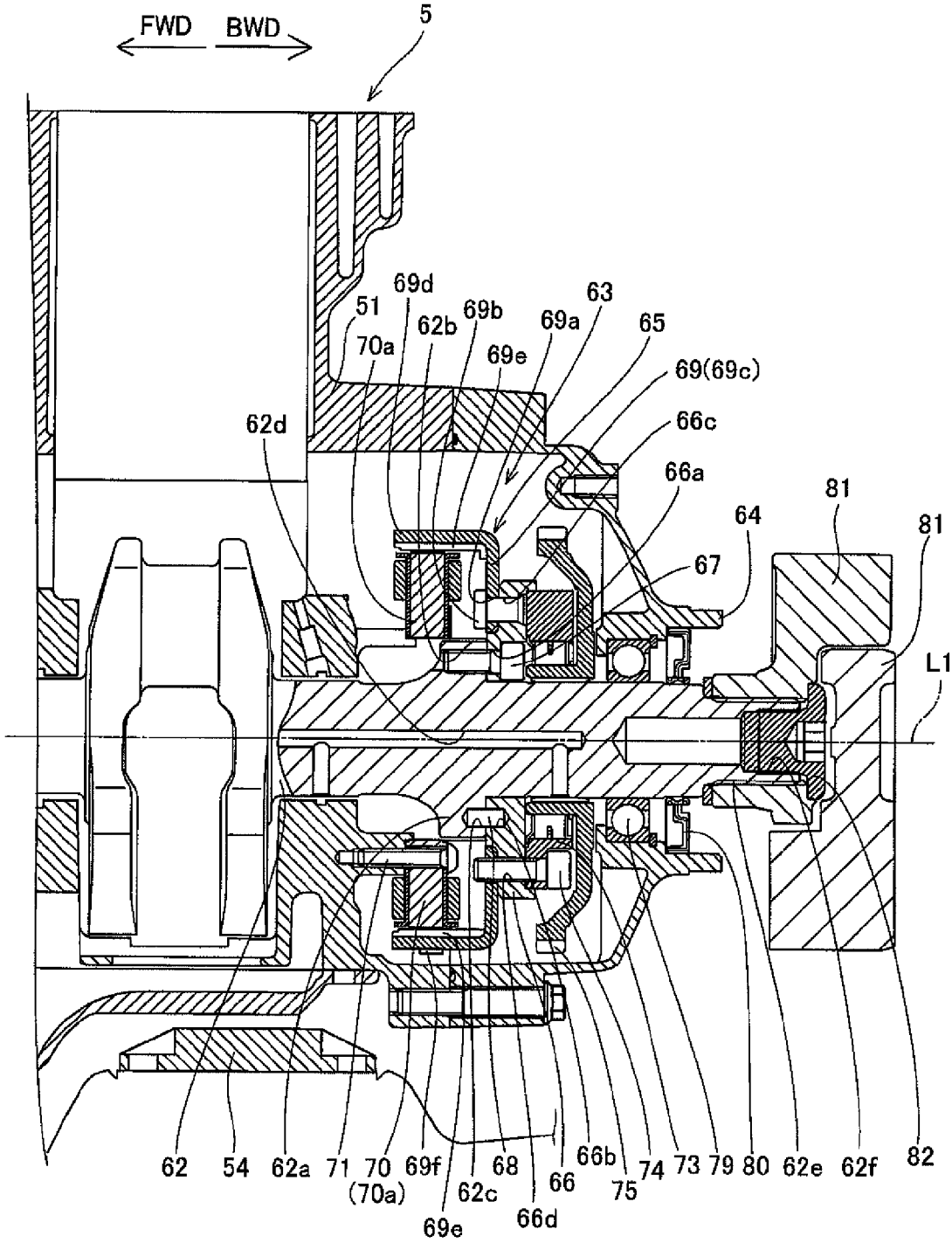
FIG. 4 is a sectional view of a vicinity of an auxiliary machinery chamber of the engine of the water jet propulsion watercraft according to the preferred embodiment shown in FIG. 1.

FIG. 4 is a further enlarged sectional view of the arrangement of a vicinity of the auxiliary machinery chamber. The crankshaft 62 is disposed so as to extend penetratingly through the auxiliary machinery chamber 63 and protrude outside the auxiliary machinery chamber 63. Thus, a rear portion of the crankshaft 62 is housed in the auxiliary machinery chamber 63. A flange portion 62*a* is formed at this rear portion. The flange portion 62*a* is formed so as to protrude in a disk-like manner from an outer peripheral surface of the crankshaft 62. A vicinity of a boundary region of the outer peripheral surface of the crankshaft 62 and the flange 62*a* at the front (in the FWD arrow direction) relative to the flange portion 62*a* preferably has a gradually curved shape. That is, an outer diameter of the crankshaft 62 gradually increases toward the flange portion 62*a* at this portion. A boundary portion of the outer peripheral surface of the crankshaft 62 and the flange 62*a* at the rear (in a BWD arrow direction) relative to the flange portion 62*a* preferably has a substantially right-angled shape. That is, a rear surface of the flange portion 62*a* is formed as a flat surface that is perpendicular to the outer peripheral surface of the crankshaft 62 at the rear of the flange portion 62*a* (that is, perpendicular to a rotational center axis L1 of the crankshaft 62). In the present preferred embodiment, the diameter of a portion of the crankshaft 62 at the rear side relative to the flange portion 62*a* is substantially uniform in the interior of the auxiliary machinery chamber 63.

Figure 5:
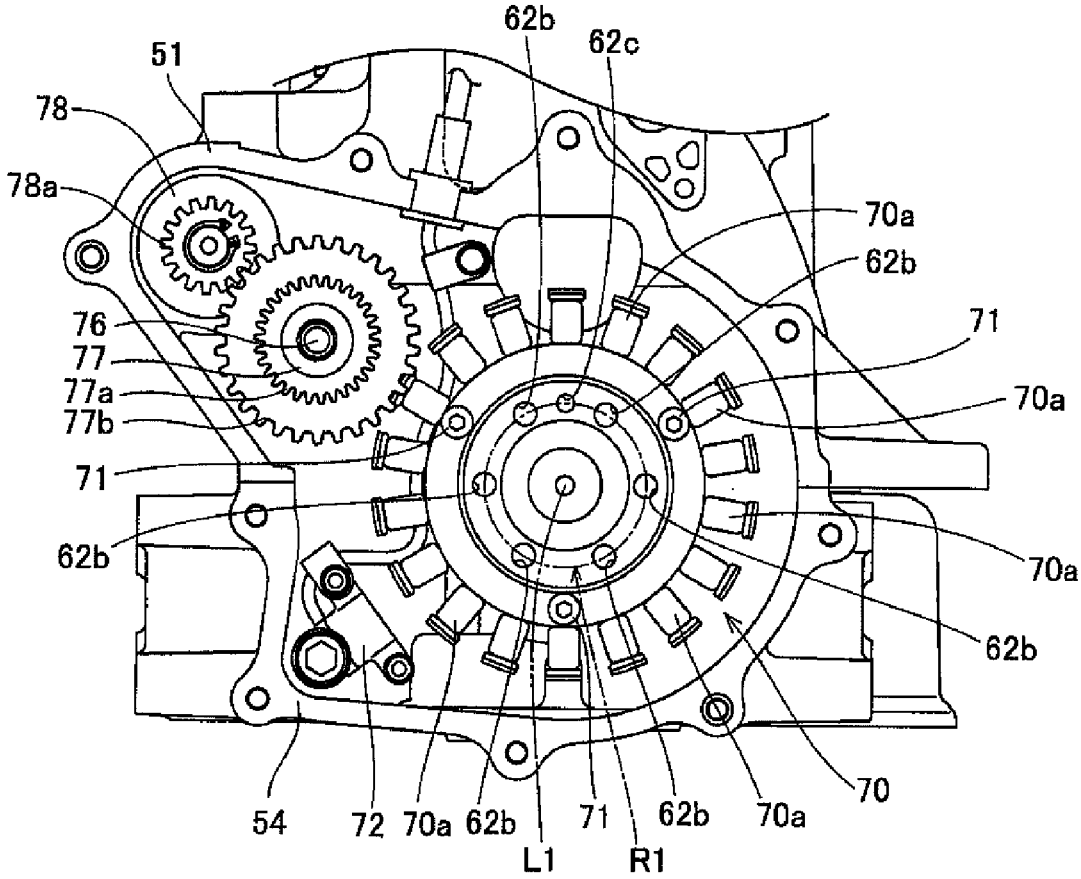
FIG. 5 is a diagram of a state where a stator unit is attached to the auxiliary machinery chamber of the water jet propulsion watercraft according to the preferred embodiment shown in FIG. 1.

FIG. 5 is a rear view of a state where the coupling 81, the cover member 64, the rotor unit 65, etc., have been removed and shows an arrangement as viewed in the FWD arrow direction in FIG. 4. A plurality (for example, preferably six in the present preferred embodiment) of screw holes 62*b* are formed in the flange portion 62*a*. The plurality of screw holes 62*b* are formed along a circumference, centered on the rotational center axis L1 of the crankshaft 62 and having a predetermined radius R1 (see FIG. 5), while being mutually spaced apart at predetermined intervals (equiangular intervals of approximately 60 degrees each). A pin hole 62*c*, enabling insertion of a positioning pin 68 to be described below, is also formed in the flange portion 62*a* at a predetermined position on the circumference R1.

Also as shown in FIG. 4, an oil passage portion 62*d* is formed in the crankshaft 62 and along the rotational center axis L1 of the crankshaft 62. The oil passage portion 62*d* is formed so as to be connected to an outer peripheral surface of the crankshaft 62 at a portion at which a one-way clutch 73 described below is disposed and is provided for supplying oil to the one-way clutch 73. Oil from the main engine body side is supplied to the oil passage portion 62*d*. Oil can thus be supplied readily to the one-way clutch 73.

Figure 7:
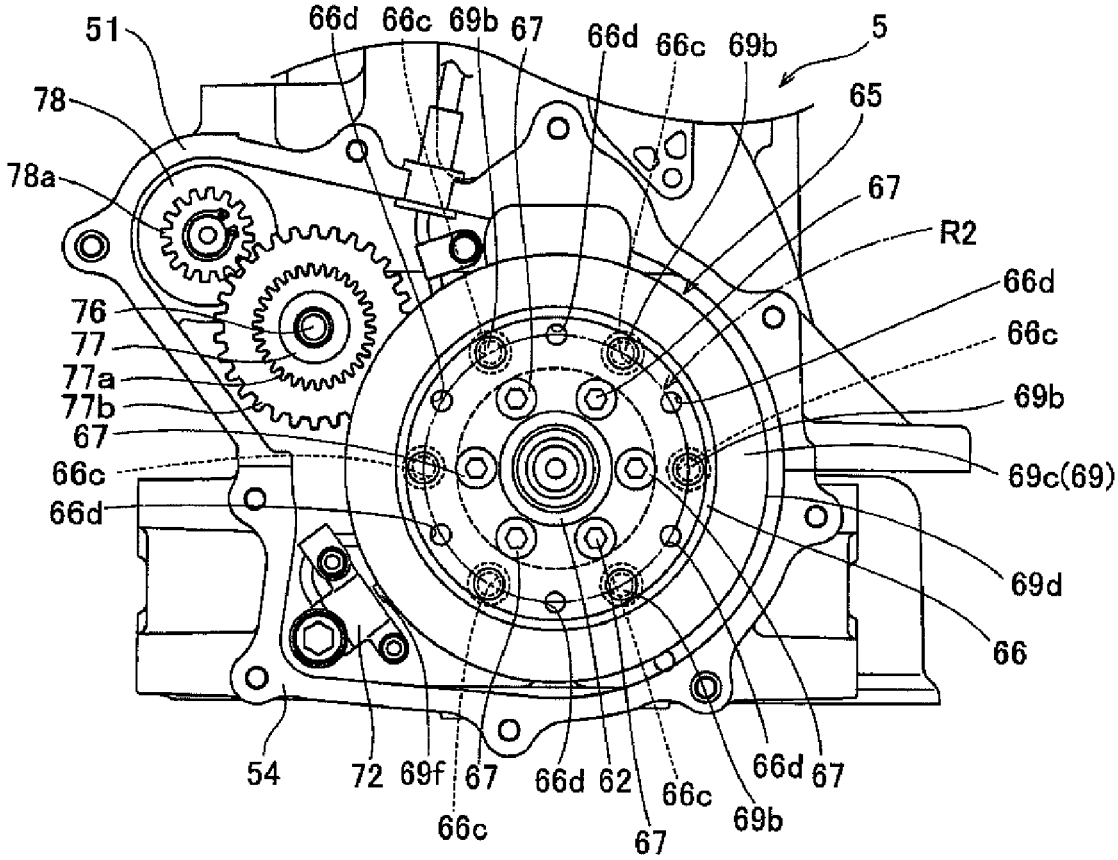
FIG. 7 is a diagram of a state where the rotor unit is attached to the auxiliary machinery chamber of the water jet propulsion watercraft according to the preferred embodiment shown in FIG. 1.

Also, with the preferred embodiment, a plate member 66 of the rotor unit 65 is attached to a rear (BWD arrow direction) side surface of the flange portion 62*a*. Specifically, a plurality (for example, preferably six in the present preferred embodiment) of screw insertion holes 66*a* are formed in the plate member 66 at positions corresponding to the six screw holes 62*b* of the flange portion 62*a*. Specifically, the six screw insertion holes 66*a* are formed at equiangular intervals of approximately 60 degrees each. The screw insertion holes 66*a* are positioned at the rear relative to the flange portion 62*a* because the plate member 66 is attached to the rear surface of the flange portion 62*a*. And, as shown in FIG. 4 and FIG. 7, to be described below, screw members 67 arranged to fasten the crankshaft 62 (see FIG. 4) and the plate member 66 are inserted into the screw insertion holes 66*a* from the rear side of the engine 5. The screw members 67 pass through the screw insertion holes 66*a* and are threadedly fixed in the screw holes 62*b* (see FIG. 4) of the crankshaft 62.

The rotor unit 65 is an example of an "auxiliary machinery." Also, the plate member 66 is an example of a "plate portion" according to a preferred embodiment of the present invention. Further, the screw insertion holes 66*a*, the screw holes 62*b*, and the screw members 67 are an example of a "fastening unit" according to a preferred embodiment of the present invention.

Figure 6:
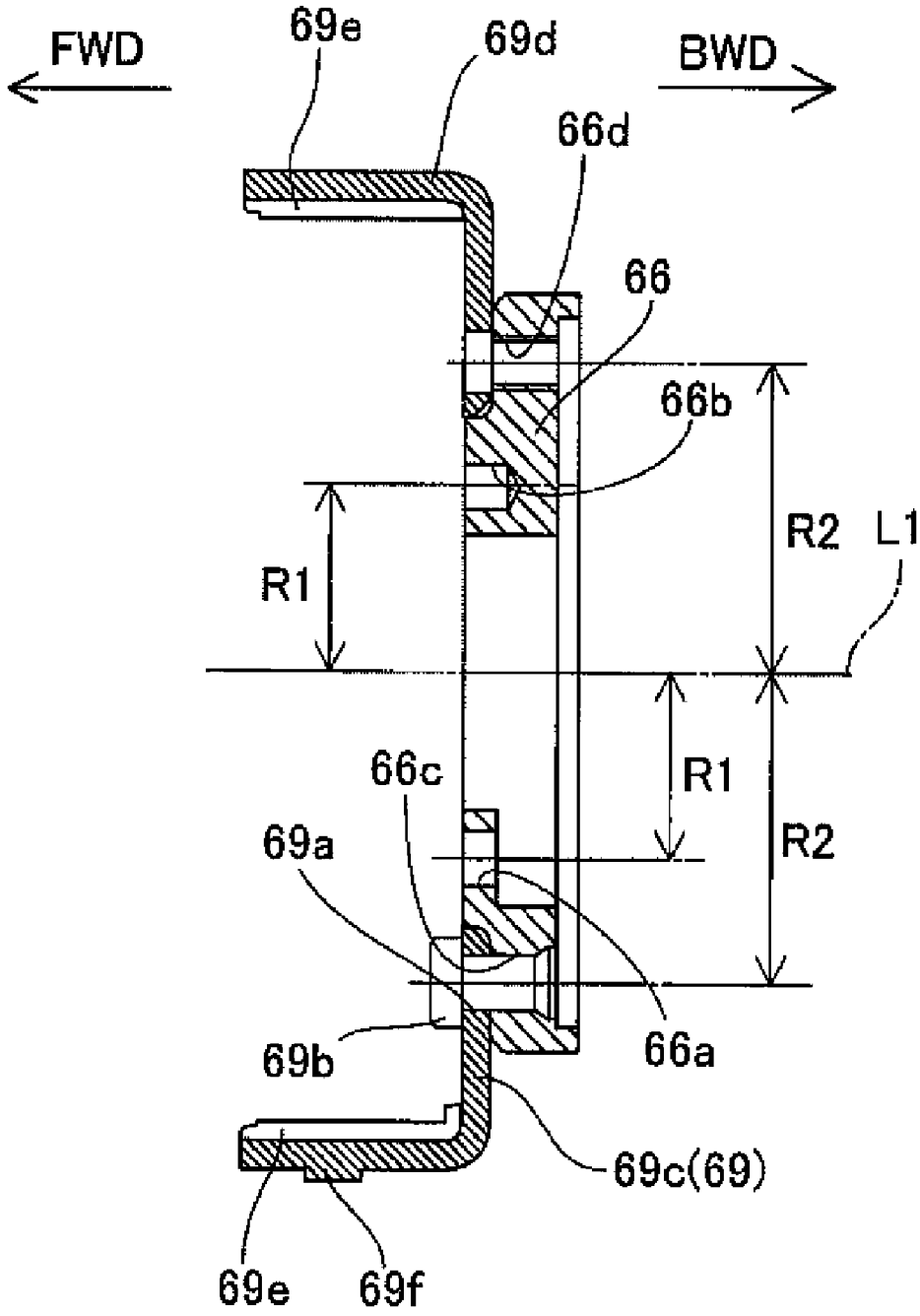
FIG. 6 is a sectional view for describing a structure of a rotor unit of the water jet propulsion watercraft according to the preferred embodiment shown in FIG. 1.

FIG. 6 is a sectional view of the structure of the rotor unit 65. Referring to FIG. 4 and FIG. 6, a pin hole 66*b* is formed in a portion corresponding to the pin hole 62*c* (see FIG. 4) of the flange portion 62*a* (see FIG. 4) at a front (FWD arrow direction) side surface of the plate member 66. As shown in FIG. 4, a positioning pin 68 is inserted into the pin hole 62*c* of the crankshaft 62 and the pin hole 66*b* of the plate member 66. The positioning pin 68 and the pin holes 62*c* and 66*c* are an example of a "positioning structure" according to a preferred embodiment of the present invention. By the positioning pin 68, a position of the plate member 66 (rotor unit 65) with respect to the crankshaft 62 in a direction of rotation about the rotational center axis L1 can be set. That is, relative rotation about the rotational center axis L1 of the rotor unit 65 with respect to the crankshaft 62 is prevented.

The plate member 66 preferably has a larger diameter than the flange portion 62*a* of the crankshaft 62. A housing 69 of the rotor unit 65 is attached to the front (FWD arrow direction) side surface of the plate member 66.

FIG. 7 is a rear view of a state where the rotor unit 65 is attached. A plurality (for example, preferably six in the present preferred embodiment) of penetrating holes 66*c* (see also FIG. 4) are formed in the plate member 66. In the present preferred embodiment, the six penetrating holes 66*c* are formed along a circumference, centered on the rotational center axis L1 of the crankshaft 62 and having a predetermined radius R2, while being mutually spaced apart at predetermined intervals (equiangular intervals of approximately 60 degrees each). As shown in FIG. 4, a plurality (e.g., six) of penetrating holes 69*a* are formed at portions of the housing 69 corresponding to the plurality (e.g., six) of penetrating holes 66*c*. The plate member 66 and the housing 69 are preferably joined together by rivets 69*b* penetrating through the penetrating holes 66*c* and 69*a*, and are thereby fastened to each other. In addition, the housing 69 is an example of a "main rotor portion" according to a preferred embodiment of the present invention. The rotor unit 65 serves a function of a flywheel that stabilizes the rotation of the crankshaft 62 by being rotated together with the crankshaft 62.

Also, the housing 69 of the rotor unit 65 includes a disk-shaped attachment portion 69*c*, in which the penetrating holes 69*a* are formed, and a peripheral wall portion 69*d*, extending toward the crankcase 54 side (front (FWD arrow direction) side) of the engine 5 from an outer peripheral portion of the attachment portion 69*c*. The peripheral wall portion 69*d* of the rotor unit 65 is disposed so as to cover the flange portion 62*a* of the crankshaft 62 and an outer periphery of the stator unit 70. The stator unit 70 is disposed so as to overlap with the flange portion 62*a* as viewed from a direction orthogonal to a direction of extension of the crankshaft 62 (FWD arrow direction). Also, a plurality of magnets 69*e* are attached to an inner peripheral surface side of the peripheral wall portion 69*d* of the rotor unit 65.

As shown in FIG. 4, the stator unit 70 is disposed in the interior of the auxiliary machinery chamber 63. The stator unit 70 is positioned so as to surround an outer peripheral portion of the crankshaft 62. Further, the stator unit 70 is positioned so as to circumferentially overlap with the flange portion 62*a* of the crankshaft 62 as viewed from a direction orthogonal to the direction of extension of the crankshaft 62 (FWD arrow direction). In addition, the stator unit 70 is an example of an "auxiliary machinery."

As shown in FIG. 4 and FIG. 5, the stator unit 70 is fixed by being screwed to the crankcase 54 and the cylinder body 51 by screw members 71. Also, the stator unit 70 is provided with a plurality of electromagnetic coils 70*a* in correspondence to the plurality of magnets 69*e* (see FIG. 4) of the rotor unit 65 (see FIG. 4). The rotor unit 65 and the stator unit 70 are thus disposed so as to oppose each other circumferentially. Thus, in accompaniment with the rotation of the rotor unit 65 together with the crankshaft 62, an electric current is generated in the electromagnetic coils 70*a* of the stator unit 70. That is, the rotor unit 65 functions as a flywheel magnet and makes up a power generator together with the stator unit 70. The power generator is thus housed as an example of an auxiliary machinery in the auxiliary machinery chamber 63.

As shown in FIG. 7, a crank angle sensor 72 is disposed at a side of the rotor unit 65. The crank angle sensor 72 is an example of an "auxiliary machinery." As shown in FIG. 4 and FIG. 7, a protrusion 69*f* is provided at an outer peripheral surface side of the peripheral wall portion 69*d* of the rotor unit 65. The protrusion 69*f* is formed at a position corresponding to the crank angle sensor 72 (see FIG. 7). The crank angle sensor 72 has a function of detecting the protrusion 69*f*. Specifically, the rotor unit 65 is rotated in accompaniment with the rotation of the crankshaft 62. The crank angle sensor 72 is arranged to detect the protrusion 69*f* when the protrusion 69*f* approaches the crank angle sensor 72 in this process. That is, the crank angle sensor 72 is arranged to detect the protrusion 69*f* and to output a detection signal each time the crankshaft 62 rotates by one turn.

Also, in the preferred embodiment, the one-way clutch 73 is attached to the rotor unit 65 as shown in FIG. 4. Specifically, the one-way clutch 73 is attached to a rear surface (surface at an opposite direction side relative to the main engine body) of the plate member 66. More specifically, a plurality (for example, preferably six in the present preferred embodiment) of screw holes 66*d* are formed in the plate member 66 as shown in FIG. 7. The plurality of screw holes 66*d* are formed along the circumference R2, centered on the rotational center axis L1 and having the predetermined radius, while being mutually spaced apart at predetermined intervals (equiangular intervals of approximately 60 degrees each). Thus, both the plurality of screw holes 66*d* and the plurality of penetrating holes 66*c* are formed along the circumference R2. The screw holes 66*d* are disposed at angular positions shifted by approximately 30 degrees each with respect to the penetrating holes 66*c*. As shown in FIG. 4, the one-way clutch 73 is fastened to the plate member 66 by screw members 74 that are screwed into the screw holes 66*d*. That is, the one-way clutch 73 is fixed to the rotor unit 65 (plate member 66), which is fixed to the flange portion 62*a* of the crankshaft 62. In addition, the one-way clutch 73 is an example of an "auxiliary machinery."

Figure 8:
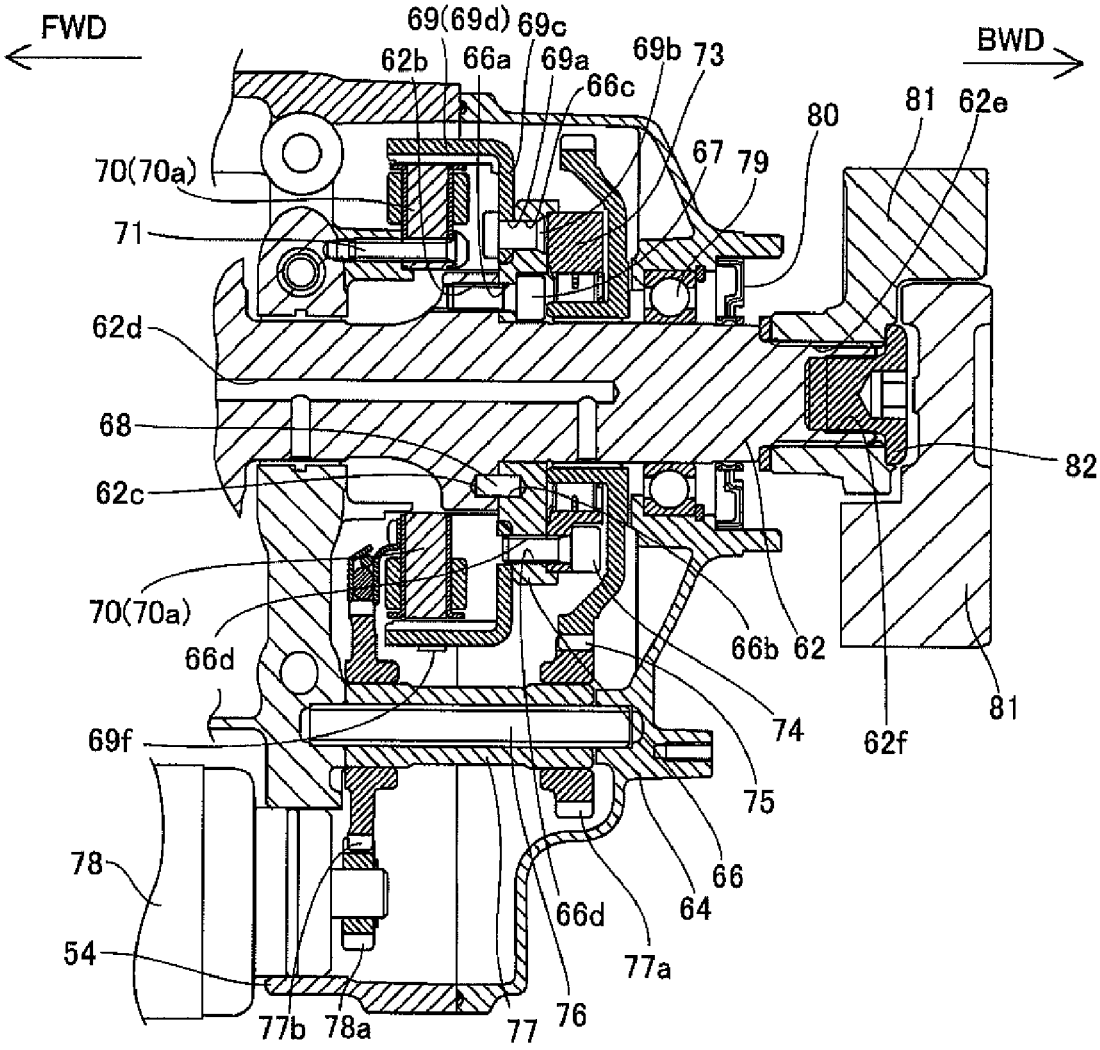
FIG. 8 is a sectional view for describing an arrangement of the auxiliary machinery chamber and a vicinity of a starter motor of the water jet propulsion watercraft according to the preferred embodiment shown in FIG. 1.

FIG. 8 is a sectional view for describing an arrangement related to starting of the engine 5. A gear 75 is attached to the one-way clutch 73. The gear 75 transmits a driving force of a starter motor 78 to the crankshaft 62 via the plate member 66. The one-way clutch 73 is disposed between the plate member 66 and the gear 75. During starting of the engine 5, the one-way clutch 73 transmits the rotation of the gear 75, which is driven by the starter motor 78, to the crankshaft 62 via the plate member 66. On the other hand, while the engine 5 is running, the one-way clutch 73 makes the gear 75 run idle with respect to the crankshaft 62 (plate member 66) so that the driving force of the crankshaft 62 is not transmitted to the gear 75. The gear 75 is one type of "auxiliary machinery" and is an example of a "second gear" according to a preferred embodiment of the present invention. The gear 75 is rotatably supported on the crankshaft 62 at the rear of the flange portion 62*a*.

As shown in FIG. 7 and FIG. 8, a support shaft 76, extending in parallel or substantially in parallel to the direction of extension of the crankshaft 62, is disposed at a side of the crankshaft 62. As shown in FIG. 8, the support shaft 76 is fixed by being sandwiched by the crankcase 54 and the cover member 64. Also, the support shaft 76 has a gear member 77 disposed rotatably with respect to the support shaft 76. The gear member 77 includes gears 77*a* and 77*b*, and the gears 77*a* and 77*b* are arranged to rotate integrally. Also, the gear 77*a* is constantly or always engaged with the gear 75 and the gear 75 is arranged to rotate in accompaniment with the rotation of the gear 77*a*.

Also, the gear 77*b* is engaged with a gear 78*a* of the starter motor 78. The starter motor 78 is arranged to be driven when the engine 5 is started. The gear 78*a* is disposed to output the driving force of the starter motor 78 to the crankshaft 62 via the gear member 77 and the gear 75. The gear 78*a* is an example of a "first gear" according to a preferred embodiment of the present invention.

The gear 78*a* of the starter motor 78 and the gear 77*b* of the gear member 77 are arranged to be in constant engagement. The gear 77*a* of the gear member 77 and the gear 75 are arranged to be in constant engagement. The gear 78*a* of the starter motor 78 and the gear 75 on the crankshaft 62 are thus coupled in a manner enabling constant transmission of power. Meanwhile, by the action of the one-way clutch 73, the driving force of the crankshaft 62 is not transmitted to the gear 75 while the engine 5 is running. That is, the gear 75 runs idle with respect to the crankshaft 62 (plate member 66). Thus, practically, the starter motor 78 is not a load while the engine 5 is running.

As shown in FIG. 4, the crankshaft 62 is supported by a bearing 79 at a rear portion of the gear 75. The bearing 79 is attached to the cover member 64, and rotatably supports the crankshaft 62 that protrudes rearward from the auxiliary machinery chamber 63. Also, a seal member 80 is disposed at the rear of the bearing 79. The seal member 80 seals an interval between the crankshaft 62 and the cover member 64 and suppresses entry of water, etc., into the interior of the auxiliary machinery chamber 63.

As shown in FIG. 2, the coupling member 81 is attached to the rear end of the crankshaft 62. The coupling member 81 includes a pair of a coupling portion at the crankshaft 62 side and a coupling portion at the drive shaft 83 side. By mutual engagement of these pair of coupling portions, the drive shaft 83 can be connected to the crankshaft 62.

As shown in FIG. 4, a screw portion 62*e* is formed on an outer peripheral surface of a rear portion of the crankshaft 62. Further, a screw hole 62*f* is formed along the rotational center axis L1 at the rear end of the crankshaft 62. The coupling member 81 is screwed to the screw portion 62*e* of the outer peripheral surface of the crankshaft 62. The coupling member 81 is arranged to be fastened to the crankshaft 62 by being rotated in a predetermined first direction with respect to the screw portion 62*e*.

Further, the coupling member 81 is fastened to the crankshaft 62 by a retaining plug 82 so as not to fall off from the crankshaft 62. The retaining plug 82 is an example of a "pressing member" according to a preferred embodiment of the present invention. The retaining plug 82 is screwed into the screw hole 62*f* while supporting (contacting) a rear end of the coupling member 81 in the FWD arrow direction. The retaining plug 82 is arranged to become fastened to the crankshaft 62 by being rotated in a second direction, which is opposite the first direction, with respect to the screw hole 62*f*. That is, the retaining plug 82 is arranged to become fastened to the crankshaft 62 when the coupling member 81 is rotated in the direction opposite the direction of being fastened to the screw portion 62*e* of the crankshaft 62. A force of fastening to the crankshaft 62 is thereby applied to the retaining plug 82 when a force is applied to the coupling member 81 in the direction of falling off from the crankshaft 62. Falling-off of the coupling member 81 from the crankshaft 62 can thus be suppressed or prevented.

The crankshaft 62 is rotated in one direction by the engine 3. When the water jet propulsion watercraft 1 is used on water, the impeller 86 receives a load due to water. This load acts to fasten the coupling member 81 to the screw portion 62*e* of the crankshaft 62. Thus, when the water jet propulsion watercraft 1 is used on water, the coupling member 81 and the crankshaft 62 are maintained in a firmly coupled state.

For maintenance after use, on the other hand, a user of the water jet propulsion watercraft 1 performs racing of the engine 5 on land. Water inside the hull 2 can thereby be eliminated. Unlike on water, a load due to water is not applied to the impeller 86 during the racing on land. Thus, when the user performs rapid closing of the accelerator from a state where it is open, a rotational speed of the crankshaft 62 decreases sharply. Consequently, a rotational direction force (load) is applied to the drive shaft 83 due to a rotational inertial force of the impeller 86 and the drive shaft 83. In such a case, the retaining plug 82 becomes fastened to the crankshaft 62. The falling-off of the coupling member 81 from the crankshaft 62 can thereby be prevented.

In the present preferred embodiment, the rear portion of the crankshaft 62 penetrates through the auxiliary machinery chamber 63 and the rear end portion thereof protrudes outside the auxiliary machinery chamber 63 as described above. The drive shaft 83 is coupled to the rear end portion. There is thus no need to provide an extended axial member or other intermediate member between the crankshaft 62 and the drive shaft 83. There is thus no need to make small the axial diameter of the crankshaft at a portion of connection of the crankshaft and an intermediate member. Consequently, the crankshaft 62 can be improved significantly in durability.

Also, the auxiliary machinery chamber 63 is disposed at the rear portion of the engine 5. The power generating apparatus, made up of the rotor unit 65 and the stator unit 70, etc., are housed inside the auxiliary machinery chamber 63. The power generating apparatus is a heavy object, and a center of gravity of the water jet propulsion watercraft 1 can thus be positioned at the rear, which contributes to the motion performance of the water jet propulsion watercraft 1.

As a result of the above, the center of gravity of the water jet propulsion watercraft 1 can be positioned rearward and, at the same time, the crankshaft 62 can be improved in durability. Further, by making integral the flange portion 62*a*, for attaching the rotor unit 65 to the crankshaft 62, the rotor unit 65 can be attached to the crankshaft 62 in a stable state.

The crankshaft 62 has a length such that it penetrates through the auxiliary machinery chamber 63, and a production cost thereof may become high correspondingly. However, the number of parts is lessened because the intermediate member can be eliminated and man-hours for assembly are reduced correspondingly. The water jet propulsion watercraft 1 is thus not necessarily increased significantly in entire production cost. That is, the motion performance of the water jet propulsion watercraft 1 and the durability of the crankshaft 62 can both be satisfied without causing a significant cost increase.

Also, with the present preferred embodiment, the pluralities of screw holes 62*b* and screw insertion holes 66*a* preferably are respectively formed in the flange portion 62*a* of the crankshaft 62 and the plate member 66 of the rotor unit 65 as described above. Using these, the crankshaft 62 and the rotor unit 65 can be fastened together. The plurality of screw holes 62*a* are arranged along the circumference R1, centered on the rotational center axis L1 of the crankshaft 62 and having the predetermined radius, while being mutually spaced apart at the predetermined intervals. The plurality of screw insertion holes 66*a* are formed at positions respectively corresponding to the plurality of screw holes 62*b*. By use of the pluralities of screw holes 62*b* and screw insertion holes 66*a*, the plate member 66 can be fastened firmly onto the crankshaft 62.

Also, with the present preferred embodiment, the screw members 67, inserted from the screw insertion holes 66*a* of the plate member 66 of the rotor unit 65, are screwingly fixed in the screw holes 62*b* of the crankshaft 62 as described above. The crankshaft 62 and the rotor unit 65 are thereby fastened together. A work of fastening the rotor unit 65 onto the crankshaft 62 can thus be performed from an outer side (rear side (BWD arrow direction side)) of the main engine body (crankcase 54). The rotor unit 65 can thus be fastened firmly and uniformly to the crankshaft 62 by an easy work.

Also, with the present preferred embodiment, the positioning pin 68 is inserted into the plate member 66 of the rotor unit 65 and the flange portion 62*a* of the crankshaft 62 as described above. The insertion position of the positioning pin 68 is a position spaced by a predetermined distance from the rotational center axis L1 of the crankshaft 62. The positioning pin 68 restricts the relative rotation of the rotor unit 65 about the rotational center axis L1 with respect to the crankshaft 62. Positioning of the rotor unit 65 in the rotational direction with respect to the crankshaft 62 can be performed thereby.

Also, with the present preferred embodiment, the rotor unit 65 includes, as described above, the plate member 66, fixed to the flange portion 62*a* of the crankshaft 62, and the housing 69, attached to the plate member 66 and formed to extend forward. The plate member 66 can thereby be fixed to be brought into planar contact with the flange portion 62*a*, and the rotor unit 65 can thus be attached with stability to the crankshaft 62. Also by attaching the housing 69 to the plate member 66, the fixing of the housing 69 to the crankshaft 62 is facilitated.

Also, with the present preferred embodiment, the plate member 66 and the housing 69 of the rotor unit 65 are fastened preferably by riveting, for example, as described above. The plate member 66 and the housing 69 can thereby be fastened firmly to each other without becoming loose by rivets 69*b*.

Also, with the present preferred embodiment, the flange portion 62*a* and the stator unit 70 are overlapped when viewed from a direction orthogonal to the crankshaft 62 as described above. Further, the stator unit 70 is circumferentially surrounded by the rotor unit 65. The flange portion 62*a* can thereby be positioned forward (toward the crankcase 54) by an amount corresponding to the overlap of the stator unit 70 with the flange portion 62*a*. Consequently, the length of the crankshaft 62*a* can be significantly reduced and minimized.

Also, with the present preferred embodiment, the diameter of the portion of the crankshaft 62 at the rear of the flange portion 62*a* is substantially uniform in the interior of the auxiliary machinery chamber 63 as described above. The durability of the crankshaft 62 can thereby be improved further.

Also, with the present preferred embodiment, when a force tending to make the coupling member 81 fall off from the crankshaft 62 acts, the retaining plug 82 presses the coupling member 81 against the crankshaft 62 as described above. The falling-off of the coupling member 81 from the crankshaft 62 can thereby be suppressed or prevented.

Also, with the present preferred embodiment, the stator unit 70 is attached to the crankcase 54 as described above. Ease of assembly is thereby improved significantly. If a configuration where the stator unit 70 is supported by the cover member 64 that covers the auxiliary machinery chamber 63 is adopted, the stator unit 70 must be attached in advance to the cover member 64. An assembly that is thus formed has a large weight as a whole because the stator unit 70 is a heavy object. When this assembly is attached to the crankcase 54, the stator unit 70 is drawn towards the magnets 69*e* of the rotor unit 65. A worker must hold, position, and attach the assembly to the crankcase 54 against both the large gravitational force and the powerful magnetic force that act on the assembly. Moreover, the cover member 64 becomes immersed in water during use of the water jet propulsion watercraft 1 and a portion between the cover member 64 and the crankcase 54 must thus be sealed in a watertight manner. The cover member 64 must therefore be positioned accurately with respect to the crankcase 54. Due to such circumstances, installation of the assembly, with which the stator unit is attached to the cover member, is very difficult.

On the other hand, the present preferred embodiment has the structure where the stator unit 70 is supported on the crankcase 54. Thus, the cover member 64, without the stator unit 70 being attached thereto, can be attached to the crankcase 54. The worker is thus relieved of the difficult task of bearing the large gravitational force and the powerful magnetic force. The workability during attachment of the cover member 64 can thereby improved and more accurate positioning of the cover member 64 is enabled.

It is extremely difficult to position the stator unit at the front relative to the rotor unit in a case where an intermediate member is coupled to the crankshaft and the drive shaft is further coupled to the intermediate member. Especially, in a case where the rotor unit has the function of the flywheel magnet, a large force in the rotational direction acts between the crankshaft and the rotor unit. The intermediate member transmits the large driving force from the crankshaft to the drive shaft, and a large load is thus applied to a coupling portion (for example, a screw coupling portion) between the crankshaft and the intermediate member. If the rotor unit is to be further coupled to the intermediate member, an even larger load is applied to the coupling portion of the intermediate member and the crankshaft. To avoid this, the rotor unit must be coupled directly to the crankshaft. This means that the rotor unit must be positioned at the front relative to the intermediate member. The rotor unit must inevitably be positioned at a position close to a rear wall of the crankcase, and a space in which the stator can be disposed is thus not provided between the rotor unit and the crankcase. The stator must inevitably be positioned at the rear of the rotor unit and support thereof must inevitably be provided by the cover member that defines the auxiliary machinery chamber.

Also, if the driving force of the starter motor is to be transmitted to the crankshaft without applying a load to the coupling portion between the intermediate member and the crankshaft, the gear that receives the driving force from the starter motor must be positioned at the front relative to the intermediate member. Such positioning of the gear makes attachment of the stator to the rear wall of the crankcase even more difficult.

On the other hand, with the present preferred embodiment, the crankshaft 62 penetrates through the auxiliary machinery chamber 63 and the flange portion 62*a* is preferably integral with the crankshaft 62 inside the auxiliary machinery chamber 63. By attaching the rotor unit 65 to the rear surface of the flange portion 62*a*, the rotor unit 65 can be coupled directly to the crankshaft 62. By then disposing the flange portion 62*a* comparatively to the rear, a space for disposing the stator unit 70 can be secured in front thereof. That is, the rotor unit attachment position can be set at the rear because the crankshaft 62 penetrates though the auxiliary machinery chamber 63. The space for disposing the stator unit 70 can thereby be secured between the rear wall of the crankcase 54 and the rotor unit 65. The stator unit 70 can thus be made to be supported by the crankcase 54. Although the rotor unit 65 is disposed comparatively at the rear, because the stator unit 70 can be disposed in front thereof, there is no concern with the auxiliary machinery chamber 63 becoming large.

Also, with the present preferred embodiment, the plurality of gears, forming the power transmission path from the gear 78*a* of the starter motor 78 to the gear 75 on the crankshaft 62, are in the constantly engaged state as described above. Further, the one-way clutch 73 that makes the gear 75 run idle with respect to the crankshaft 62 is provided while the engine 5 is running. The driving force of the starter motor 78 is thus transmitted to the crankshaft 62 via the one-way clutch 73 during the starting of the engine 5. While the engine 5 is running, the power transmission path from the crankshaft 62 to the starter motor 78 is interrupted by the one-way clutch 73. By this structure, the need to disengage the engagement of the gear 78*a* with the gears 77*a*, 77*b*, and 75 is eliminated. Damaging of the gears and the starter motor that occurs readily when engagement and disengagement of the gears with each other are repeated can thus be prevented.

It is to be understood that the preferred embodiments disclosed herein is by all means illustrative and not restrictive. The scope of the present invention is defined by the claims and not by the preceding description of the preferred embodiments, and all changes that fall within the metes and bounds of the claims or equivalence of such meets and bounds are therefore intended to be embraced by the claims.

For example, in the preferred embodiments described above, the rotor unit, the stator unit, the one-way clutch, and the gears have been described as examples of the auxiliary machinery housed in the auxiliary machinery chamber 63. However, for example, a sprocket for driving a cam shaft and other auxiliary machinery may also be housed in the auxiliary machinery chamber 63.

Further, although with the preferred embodiments described above, an example where the flange portion of the crankshaft and the plate member of the rotor unit are fastened by the screw members has been described, the present invention is not restricted thereto. For example, the same object can be attained by riveting. The same object can also be attained by a structure that fastens the flange portion and the plate member by a coupling that clamps two flange portions.

Also, although in the preferred embodiments described above, the plate member and the housing of the rotor unit are preferably fastened by rivets, the present invention is not restricted thereto, and a fastening member besides rivets may be used. For example, the plate member and the housing of the rotor unit may be fastened by a screw member. Also, the rotor unit may be formed as an integral unit having a portion corresponding to the plate member and a portion corresponding to the housing.

Also, in the preferred embodiments described above, the screw holes of the flange portion of the crankshaft are preferably formed along the circumference, centered on the rotational center axis of the crankshaft and having the predetermined radius, while being mutually spaced apart at the predetermined intervals. The screw insertion holes of the plate member of the rotor unit are preferably formed to be matched to the screw holes. However, the present invention is not restricted thereto. For example, the screw holes of the flange portion of the crankshaft and the screw insertion holes of the plate member of the rotor unit may be positioned at positions deviating from a circumference such as that described above. Also, the screw holes of the flange portion of the crankshaft and the screw insertion holes of the plate member of the rotor unit also do not have to be positioned at equal intervals.

Also, although with the preferred embodiments described above, an example of applying the positioning pin that sets the position of the rotor unit with respect to the crankshaft has been described as an example of the positioning structure of the present invention, the present invention is not restricted thereto. For example, an engaging hole or an engaging groove may be provided in one of either the crankshaft or the rotor unit and an engaging protrusion, engageable with the engaging hole or the engaging groove, may be provided in the other of either the crankshaft or the rotor unit. Or, a key may be provided in one of either the crankshaft or the rotor unit, and a key groove, engageable with the key, may be provided in the other of either the crankshaft or the rotor unit.

Also, although with the preferred embodiments described above, the coupling member is attached to the crankshaft by screwing onto the screw portion formed on the outer peripheral surface of the crankshaft, the present invention is not restricted thereto. For example, a flange may be provided at the rear end of the crankshaft, and the coupling member may be fastened to this flange.

Also, with the preferred embodiments described above, although an example of connecting the crankshaft and the drive shaft by the coupling member has been described, the present invention is not restricted thereto. For example, the crankshaft and the drive shaft may be connected by a flange fastening. That is, a flange may be formed at the rear end of the crankshaft, a flange may be formed at the front end of the drive shaft, and these flanges may be fastened together. Or, the crankshaft and the drive shaft may be connected by a weld joint, for example.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2008-243558 filed in the Japanese Patent Office on Sep. 24, 2008, and the entire disclosure of the application is incorporated herein by reference.

What is claimed is:

1. A water jet propulsion watercraft comprising:

a main engine body;

a rotor chamber disposed at a rear portion of the main engine body;

a crankshaft disposed so as to extend penetratingly through the rotor chamber such that a rear end portion of the crankshaft protrudes to an outer side of the rotor chamber, the crankshaft having a flange portion that is integral with the crankshaft inside the rotor chamber;

a rotor unit housed in the rotor chamber and fixed to the flange portion;

a stator unit combined with the rotor unit to make up a power generator;

a drive shaft connected to the rear end portion of the crankshaft and arranged to be rotated together with the crankshaft; and a jet propulsion unit arranged to suck in and jet out water and including an impeller that is coupled to the drive shaft.

2. The water jet propulsion watercraft according to claim 1, wherein the rotor unit includes a flywheel unit fixed to the flange portion of the crankshaft and arranged to stabilize rotation of the crankshaft by being rotated together with the crankshaft.

3. The water jet propulsion watercraft according to claim 1, wherein the rotor unit is fixed to a rear surface of the flange portion, and a portion of the rotor unit extends forward so as to cover an outer peripheral portion of the flange portion.

4. The water jet propulsion watercraft according to claim 1, further comprising a plurality of fastening units arranged to fasten the rotor unit to the flange portion of the crankshaft, wherein the plurality of fastening units are mutually spaced apart at predetermined intervals along a circumference at a predetermined radius centered on a rotational center axis of the crankshaft.

5. The water jet propulsion watercraft according to claim 4, wherein each of the fastening units includes a screw insertion hole arranged in a portion of the rotor unit rearward of the flange portion of the crankshaft, a screw hole arranged in the flange portion of the crankshaft, and a screw member arranged to pass through the screw insertion hole of the rotor unit and to be threadedly fixed in the screw hole of the flange portion of the crankshaft.

6. The water jet propulsion watercraft according to claim 1, further comprising a positioning structure disposed at a position spaced by a predetermined distance from a rotational center axis of the crankshaft, and arranged to restrict relative rotation of the flange portion and the rotor unit about the rotational center axis and to set a position of the rotor unit with respect to the crankshaft.

7. The water jet propulsion watercraft according to claim 1, wherein the rotor unit includes a plate portion fixed to the flange portion of the crankshaft and positioned at the rear of the flange portion, and a main rotor portion attached to the plate portion and arranged to extend forward.

8. The water jet propulsion watercraft according to claim 7, wherein the plate portion and the main rotor portion of the rotor unit are riveted to each other.

9. A water jet propulsion watercraft comprising:

a main engine body;

a rotor chamber disposed at a rear portion of the main engine body;

a crankshaft disposed so as to extend penetratingly through the rotor chamber such that a rear end portion of the crankshaft protrudes to an outer side of the rotor chamber, the crankshaft having a flange portion that is integral with the crankshaft inside the rotor chamber;

a rotor unit housed in the rotor chamber and fixed to the flange portion;

a stator unit disposed inside the rotor chamber so as to overlap with the flange portion when viewed from a direction that is perpendicular or substantially perpendicular to the crankshaft, the stator unit having a periphery surrounded by the rotor unit;

a drive shaft connected to the rear end portion of the crankshaft and arranged to be rotated together with the crankshaft; and a jet propulsion unit arranged to suck in and jet out water and including an impeller that is coupled to the drive shaft.

10. The water jet propulsion watercraft according to claim 1, wherein a portion of the crankshaft located rearward of the flange portion has a substantially uniform diameter in an interior of the rotor chamber.

11. The water jet propulsion watercraft according to claim 1, further comprising:

a coupling member attached to the crankshaft, and arranged to connect the crankshaft and the drive shaft; and a pressing member attached to the crankshaft so as to press the coupling member toward the crankshaft, and arranged to prevent the coupling member from detaching from the crankshaft.

12. A water jet propulsion watercraft comprising:

a main engine body;

a rotor chamber disposed at a rear portion of the main engine body;

a crankshaft disposed so as to extend penetratingly through the rotor chamber such that a rear end portion of the crankshaft protrudes to an outer side of the rotor chamber, the crankshaft having a flange portion that is integral with the crankshaft inside the rotor chamber;

a rotor unit housed in the rotor chamber and fixed to the flange portion;

a drive shaft connected to the rear end portion of the crankshaft and arranged to be rotated together with the crankshaft; and a jet propulsion unit arranged to suck in and jet out water and including an impeller that is coupled to the drive shaft; wherein the main engine body includes a crankcase arranged to house the crankshaft, and the water jet propulsion watercraft further comprises:

a stator unit disposed inside the rotor chamber so as to surround an outer peripheral portion of the crankshaft in an interior of the rotor chamber, the stator unit being attached to the crankcase.

13. The water jet propulsion watercraft according to claim 1, further comprising:

a starter motor arranged to be driven when the engine is started;

a first gear arranged to output a driving force of the starter motor;

a second gear coupled to the first gear in a manner enabling constant transmission of power, and arranged to transmit the driving force of the starter motor to the crankshaft; and a one-way clutch disposed between the rotor unit and the second gear, and arranged to make the second gear run idle with respect to the crankshaft such that the driving force of the crankshaft is not transmitted to the second gear while the engine is running.

14. The water jet propulsion watercraft according to claim 13, wherein the crankshaft further includes an oil passage portion arranged to supply oil to the one-way clutch.

15. The water jet propulsion watercraft according to claim 13, wherein the one-way clutch is fixed to the rotor unit.

16. The water jet propulsion watercraft according to claim 13, wherein the second gear is rotatably supported on the crankshaft rearward of the flange portion.

17. A water jet propulsion watercraft comprising:

a main engine body including a crankcase arranged to house a crankshaft;

a rotor chamber disposed at a rear portion of the main engine body and defined by the crankcase, the crankshaft extending and penetrating through the rotor chamber such that a rear end portion of the crankshaft protrudes to an outer side of the rotor chamber, the crankshaft including a flange portion that is integral with the crankshaft inside the rotor chamber;

a rotor unit housed in the rotor chamber and fixed to the flange portion;

a drive shaft connected to the rear end portion of the crankshaft and arranged to be rotated together with the crankshaft; and a jet propulsion unit arranged to suck in and jet out water and including an impeller that is coupled to the drive shaft.

18. The water jet propulsion watercraft according to claim 17, wherein the rotor unit is a rotor unit of a power generator that generates electricity.

19. The water jet propulsion watercraft according to claim 17, further comprising a stator unit disposed inside the rotor chamber and opposed to the rotor unit.

20. The water jet propulsion watercraft according to claim 19, wherein the stator unit is positioned at a front side of the rotor unit.

* * * * *